US011638505B2

(12) United States Patent
McBride et al.

(10) Patent No.: US 11,638,505 B2
(45) Date of Patent: May 2, 2023

(54) WIPE DISPENSING SYSTEM

(71) Applicant: Contec, Inc., Spartanburg, SC (US)

(72) Inventors: John McBride, Spartanburg, SC (US); Jeremy Parker Davis, Moore, SC (US)

(73) Assignee: CONTEC, INC., Spartanburg, SC (US)

( * ) Notice: Subject to any disclaimer, the term of this patent is extended or adjusted under 35 U.S.C. 154(b) by 32 days.

(21) Appl. No.: 17/522,587

(22) Filed: Nov. 9, 2021

(65) Prior Publication Data

US 2022/0142419 A1 May 12, 2022

Related U.S. Application Data

(60) Provisional application No. 63/111,388, filed on Nov. 9, 2020.

(51) Int. Cl.
*A47K 10/42* (2006.01)
*A47K 10/32* (2006.01)

(52) U.S. Cl.
CPC .... *A47K 10/421* (2013.01); *A47K 2010/3233* (2013.01); *A47K 2010/3266* (2013.01)

(58) Field of Classification Search
None
See application file for complete search history.

(56) References Cited

U.S. PATENT DOCUMENTS

| | | | | |
|---|---|---|---|---|
| 11,291,338 | B2 * | 4/2022 | Wexler | B65D 83/0805 |
| 2016/0143490 | A1 * | 5/2016 | Yamada | A47K 10/426 221/45 |
| 2017/0245699 | A1 * | 8/2017 | Keily | A47K 10/38 |
| 2017/0354299 | A1 * | 12/2017 | Schöler | A47K 10/38 |

* cited by examiner

*Primary Examiner* — Gene O Crawford
*Assistant Examiner* — Ayodeji T Ojofeitimi
(74) *Attorney, Agent, or Firm* — J. M. Robertson, LLC

(57) ABSTRACT

A wipe dispensing system including a wall-mountable dispenser adapted to clamp a bag of wipes and optional saturating fluid in place in hanging relation below the dispenser such that no additional support structure is required. The mounting locations can be selected to provide access at varying heights directly against a wall without relying on a shelf thereby promoting availability to wheelchair users. Moreover, very little space is required since the bags hang down against the support wall thereby maintaining a relatively small outwardly projecting profile.

15 Claims, 6 Drawing Sheets

WIPE DISPENSING SYSTEM

CROSS-REFERENCE TO RELATED APPLICATION(S)

This nonprovisional application claims the benefit of, and priority from, U.S. provisional application 63/111,388 filed 9 Nov. 2020. The contents of such prior application and any other documents referenced in this application are hereby incorporated by reference in their entirety as if fully set forth herein.

TECHNICAL FIELD

The present disclosure relates generally to cleaning products, and more particularly to a dispensing system for saturated cleaning wipes stored in a soft-sided pliable bag containing the wipes and a saturating liquid for cleaning and/or disinfection.

BACKGROUND

In settings such as public waiting rooms, restaurants, airports, gyms, buses and the like, it may be desirable for users and/or cleaning staff to have access to disposable wipes pre-saturated with cleaning and/or disinfecting solution for use in cleaning and sanitizing surfaces before and after use. Such wipe products are well known and are typically packaged in small disposable cannisters. While such small packaging is convenient for use in the home or in a controlled work environment, the use of small portable containers may not be practical in public settings. Specifically, such packaging may have to be frequently replaced and may be susceptible to theft. Moreover, using larger cannisters may be impractical due to space limitations and does not overcome the issue of possible theft. Additionally, public settings may lack a proper shelf or other support surface for placement of free-standing cannisters.

A further difficulty associated with using either large or small cannisters is that cleaning staff without proper training may inadvertently place the products in sub-optimal locations. Finally, cannisters may not be suitable for wall mounting in compliance with requirements under various laws and regulations such as the Americans with Disabilities Act (ADA) and the like which promote access for persons in wheelchairs or having other physical challenges. Conversely dispensing systems in accordance with the present disclosure may be made fully compliant with such laws and regulations.

In recognition of these deficiencies, an ADA compliant system that is suitable for wall mounting and which provides large quantities of pre-saturated wipes without requiring substantial space and which reduces the possibility of theft would represent a useful advancement over the current art.

SUMMARY

The present disclosure offers advantages and alternatives over the prior art by providing a wipe dispensing system including a wall-mountable dispenser adapted to clamp a bag of wipes and saturating fluid in place in hanging relation below the dispenser such that no additional support structure is required. By mounting the dispensers at optimal locations, large quantities of wipes can be made available where most needed. The mounting locations can be selected to provide access at varying heights directly against a wall without relying on a shelf thereby promoting availability to wheelchair users. Moreover, very little space is required since the bags hang down against the support wall thereby maintaining a relatively small outwardly projecting profile. Additionally, the clamping arrangement substantially eliminates the possibility of theft. These and other benefits will be recognized through reference to the accompanying drawings and corresponding description below.

BRIEF DESCRIPTION OF THE DRAWING(S)

Figure 1:
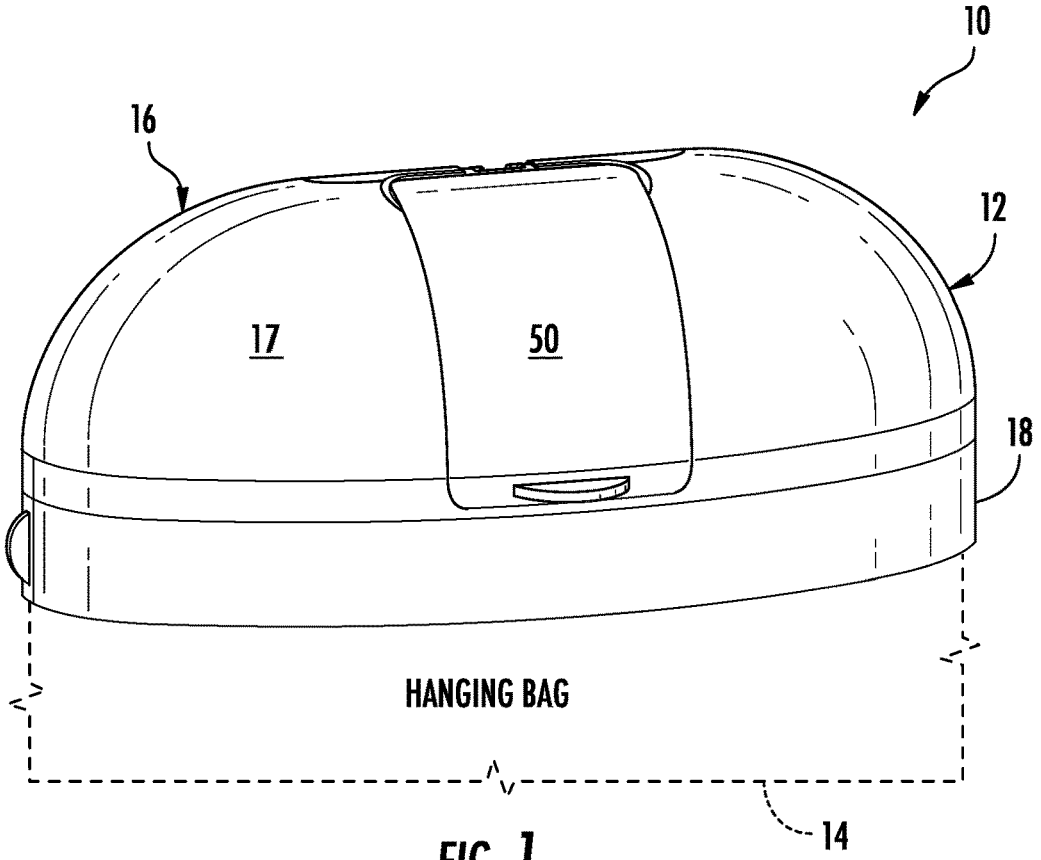
FIG. 1 is a perspective view of a wipe dispensing system consistent with the present disclosure including a wall-mountable dispenser in clamping relation to a downwardly extending hanging bag.

Before embodiments of the disclosure are explained in detail, it is to be understood that the disclosure is not limited in its application to the details of construction and the arrangements of the components set forth in the following description or illustrated in the drawings. The disclosure is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DESCRIPTION OF PREFERRED EMBODIMENTS

Exemplary embodiments consistent with the present disclosure will now be described through reference to the drawings wherein like elements are designated by like reference numerals in the various views. Preferred embodiments of this disclosure are described herein, including the best mode known to the inventor for carrying out the disclosure. Variations of those preferred embodiments may become apparent to those of ordinary skill in the art upon reading the following description. The inventors and applicant expect skilled artisans to employ such variations as appropriate and intend expect that the disclosure may be practiced otherwise than as specifically described herein. Accordingly, this disclosure includes all modifications and equivalents of the subject matter recited in the claims appended hereto as permitted by applicable law. Moreover, any combination of the elements described herein in all possible variations thereof is encompassed by the disclosure unless otherwise indicated herein or otherwise clearly contradicted by context.

Referring now to the drawings, an exemplary wipe dispensing system 10 consistent with the present disclosure is shown. As illustrated, the exemplary wipe dispensing system 10 includes a wall-mountable dispenser 12 in clamping relation to a downwardly extending hanging bag 14 (shown in phantom) containing a roll or folded arrangement of pre-saturated wipes in combination with a cleaning and/or disinfection solution (not shown). In this regard, the hanging bag 14 may be formed from any suitable pliable material such as plastic or the like with sufficiently low permeability to prevent leaking and evaporation of the cleaning and/or disinfection solution. Such pliable bag material will be well known to those of skill in the art. The hanging bag 14 will preferably include a tear opening or other withdrawal opening along an upper edge held within the dispenser 12 for alignment with an opening in the dispenser 12 for withdrawal of the wipes by a user as will be described further hereinafter.

Figure 2:
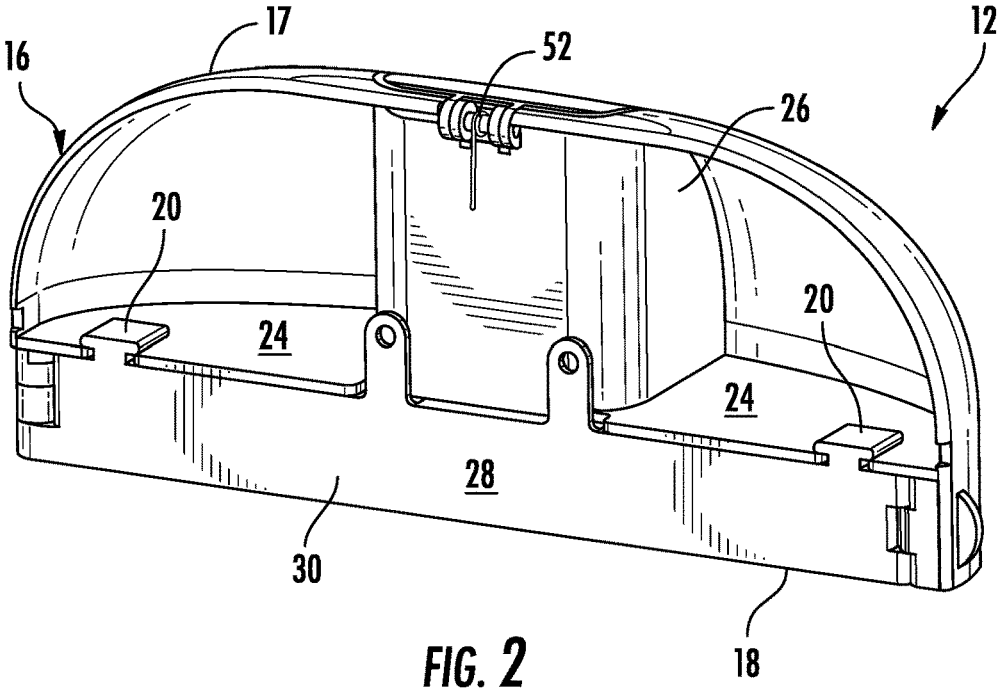
FIG. 2 is a rear view of the wall-mountable dispenser of FIG. 1 illustrating the mounting surface.
Figure 3:
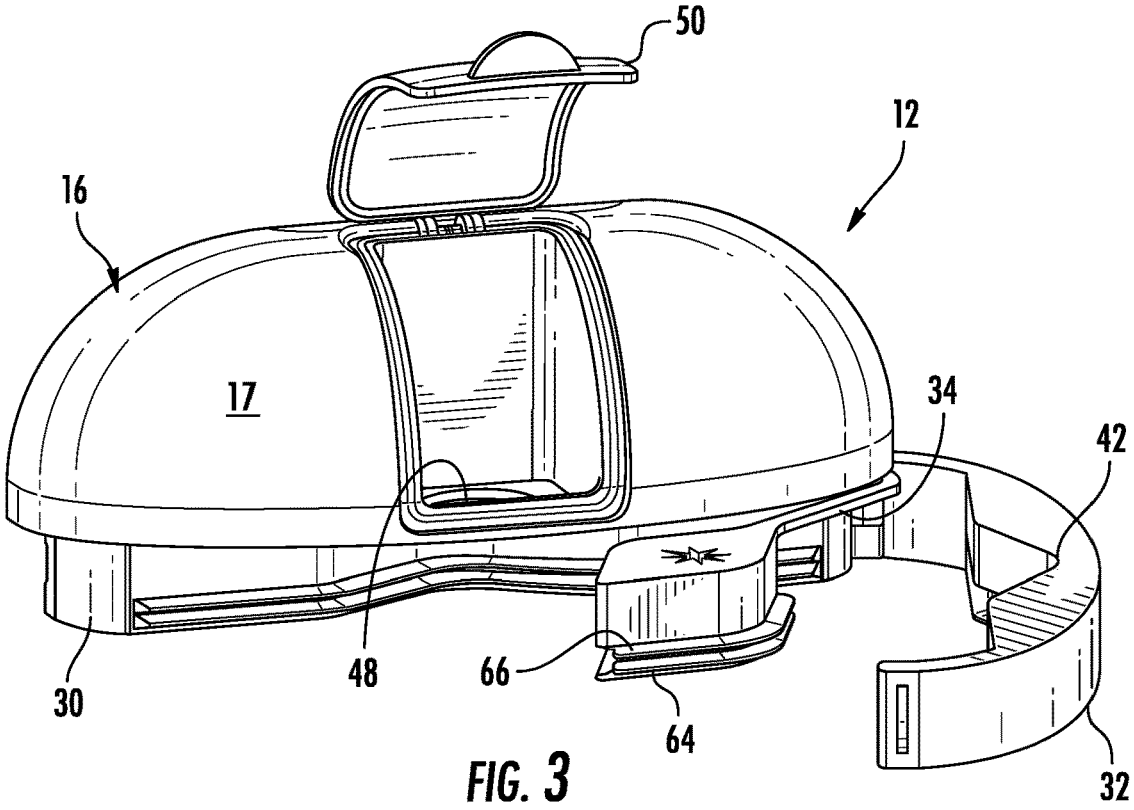
FIG. 3 is a front view of the wall-mountable dispenser of FIG. 1 in open condition with no bag in place illustrating the dispensing port and hinging clamping members in extended condition.

The dispenser 12 is preferably formed from an injection molded thermoplastic material such polyester, nylon, acetal polymer or like although other polymeric or non-polymeric materials may likewise be used. As best seen through joint reference to FIGS. 2-4, the dispenser 12 may include a cover 16 which is removably attached to a base 18. In the illustrated exemplary construction, cover 16 may include an exterior shroud portion 17 having have a split dome configuration with a substantially flat rear surface and a convex curved outer face. As best seen in FIG. 2, cover 16 may include an internal flooring surface 24 and an internal access compartment 26 having raised walls extending upwardly away from flooring surface 24.

By way of example only, and not limitation, cover 16 and base 18 may be held together by raised platform posts 20 extending upwardly from base 18. In this regard, raised platform posts 20 may snap over flooring surface 24 of cover 16 (FIG. 2) at locations outboard from internal access compartment 26. Using this construction, base 18 may be first mounted to a wall or other support surface using mounting tabs 22 (FIG. 4) which are adapted to receive screws or other attachment elements which pass through openings in the mounting tabs to engage a supporting wall (not shown) or other support surface. Once base 18 is in place, cover 16 may then be pushed into place with portions of flooring surface 24 secured under the platform posts 20 to establish a reversible connection.

As illustrated, in the exemplary construction base 18 includes a mounting arm 30 disposed along the rear side which supports the platform posts 20 and the mounting tabs 22. The mounting arm 30 may include a substantially flat rear surface 28 for disposition is opposing relating to a flat wall surface. In the illustrated exemplary construction, mounting tabs 22 project upwardly away from the rear surface with the rear of the mounting tabs being generally coplanar with rear surface 28 of mounting arm 30 to facilitate attachment to a flat support surface. In the illustrated exemplary construction, base 18 also includes an outer clamping arm 32 and an interior clamping arm 34. The interior clamping arm 34 is located between the mounting arm 30 and the outer clamping arm 34. Outer clamping arm 32 and an interior clamping arm 34 may move independently from one another about a common hinging axis or different axes. Accordingly, when mounting arm 30 is secured to a support wall, outer clamping arm 32 and an interior clamping arm 34 may pivot outwardly away from the support wall. As illustrated, in the outwardly pivoted configuration (FIGS. 3-6), spacing is established on either side of interior clamping arm 34. This spacing may be used to accept opposing edges of an opening in hanging bag 14 to clamp the bag in place when outer clamping arm 32 and interior clamping arm 34 are pivoted back to a closed position. Wipes may then be withdrawn through the bag opening between the clamped edges.

Figure 4:
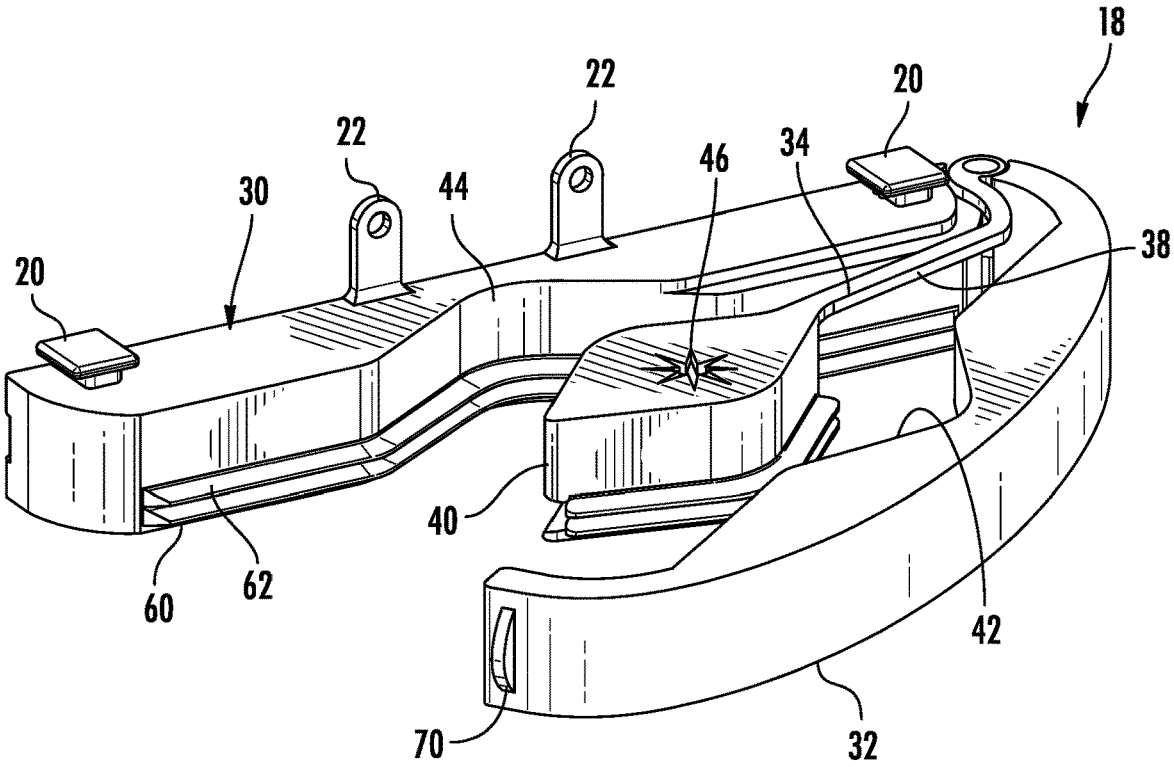
FIG. 4 illustrates the base of the wall-mountable dispenser of FIGS. 1 and 3 with the hinging clamping members in extended condition and with the cover removed.
Figure 5:
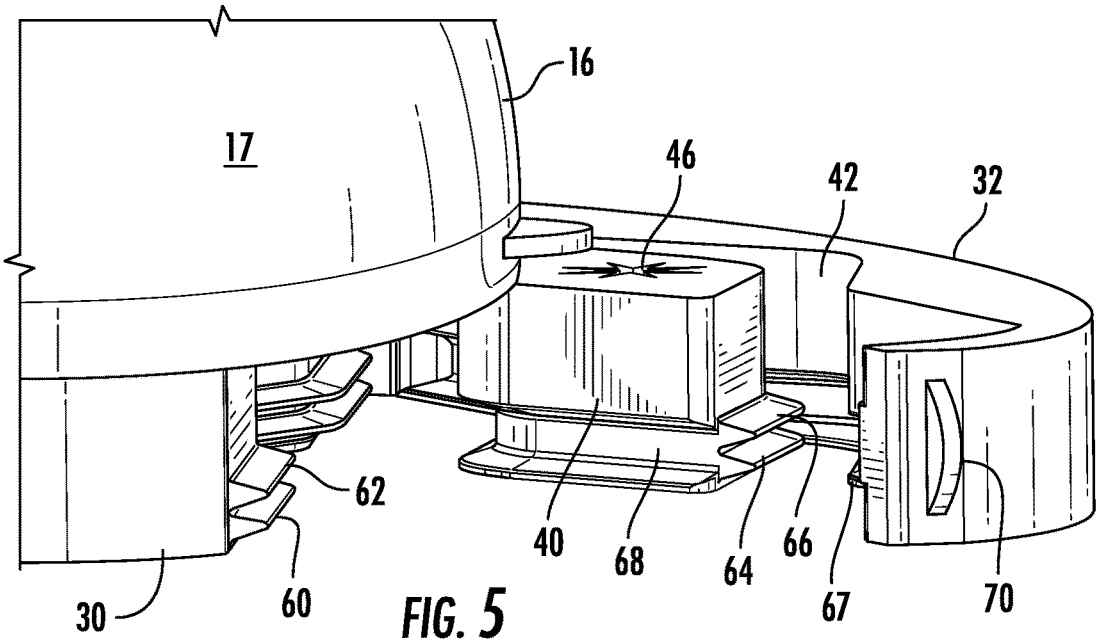
FIG. 5 is a side view of the wall-mountable dispenser of FIGS. 1 and 3 illustrating the hinging clamping members in extended condition.

As best seen through reference to FIG. 4, interior clamping arm 34 may include a proximal arm segment 38 and a substantially diamond-shaped floating island 40 at its distal end. As shown, floating island 40 preferably has an enhanced effective diameter and thickness relative to the proximal portion of interior clamping arm 34. Of course, floating island 40 is not limited to a diamond shape and alternative polygonal or curved structures including ovals, circles, rectangles, hexagons and the like may likewise be used. As will be appreciated, floating island 40 can move towards or away from mounting arm 30 by pivoting interior clamping arm 34 about its hinging axis.

As illustrated, in the exemplary construction floating island 40 is configured to nest between opposing complementary indents 42, 44 in outer clamping arm 32 and mounting arm 30. Accordingly, while the illustrated diamond-shaped floating island structure 40 may be desirable, other polygonal or non-polygonal shapes may likewise be used, including pentagons, hexagons, ovals, circles, and the like.

Figure 6:
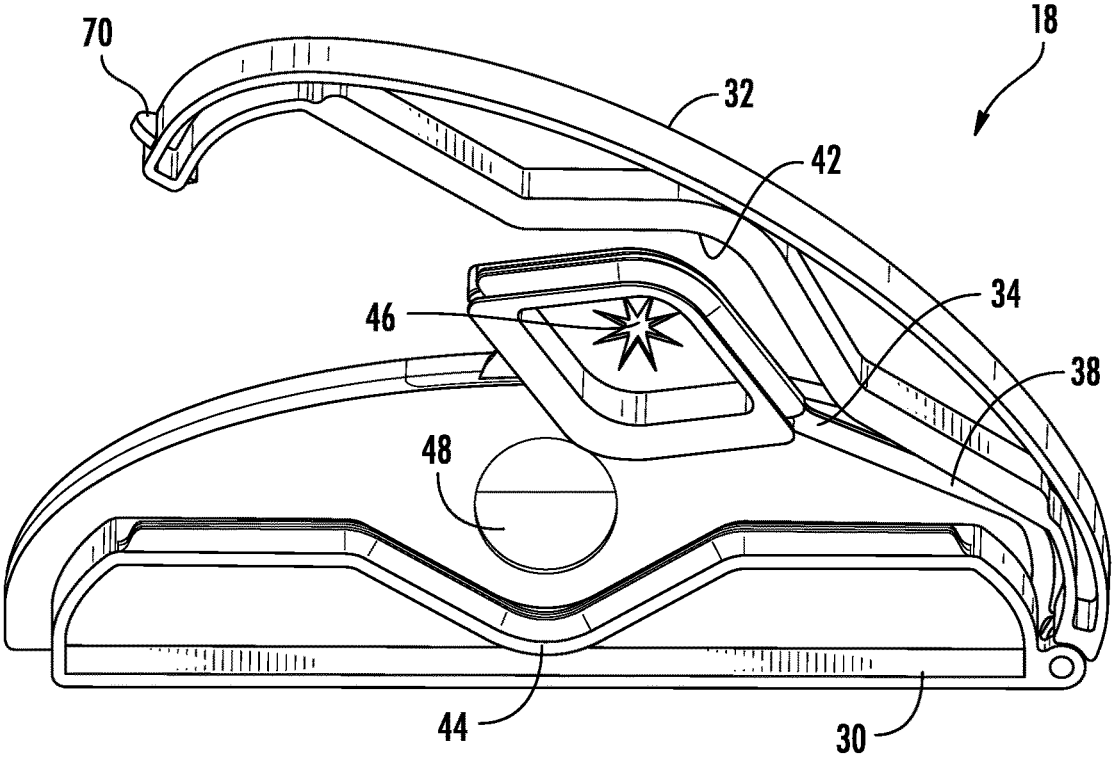
FIG. 6 is a bottom view of the wall-mountable dispenser of FIGS. 1 and 3 illustrating the hinging clamping members in extended condition.

As best seen through reference to FIG. 6, floating island 40 has a concave interior with a pass-through surface opening 46 for withdrawal of wipes on an individualized basis. In this regard, while a substantially star-shaped opening may be desirable, any other suitable shape may likewise be used. During use of the wipe dispensing system 10, the concave interior of floating island 40 may be substantially aligned with a tear opening or the like on an upper edge of the hanging bag 14 such that wipes may be pulled out of the bag opening and through pass-through surface opening 46 and an aligned slot opening 48 in the floor of cover 16.

In the illustrated exemplary construction, a selectively opening door 50 may be disposed within the cover to provide access to internal access compartment 26 for wipe withdrawal during use. In this regard, door 50 may be normally biased to a closed position by a spring hinge 52 (FIG. 2) thereby maintaining a closed environment within cover 16 between uses. As will be appreciated, maintaining such a closed environment may aid in preventing undesired premature evaporation of saturating solutions within hanging bag 14 thereby keeping the wipes moist.

As noted previously, base 18 may act to securely clamp hanging bag 14 in place during use. In the illustrated exemplary construction, this clamping function is facilitated by a pair of spaced ridges 60, 62 projecting outwardly away from an interior surface of the mounting arm 30 and towards the clamping arms 32, 34. A corresponding pair of spaced ridges 64, 66 projects outwardly away from the floating island 40 and towards the outer clamping arm 32. An opposing ridge element 67 projects away from the outer clamping arm 32 for insertion in the grooves between the spaced ridges 60, 62, 64, 66 when the base 18 is closed. A perimeter channel 68 (FIG. 5) at the base of floating island 40 receives and retains the opposing segment of ridges 60, 62 which do not engage the outer clamping arm 32 when the base 18 is closed.

The arrangement of complementary ridges and grooves provides a secure clamping arrangement for the hanging bag 14 within base 18 during use.

Specifically, the pliable bag material on either side of a withdrawal opening may be pressed into the grooves between the spaced ridges 60, 62, 64, 66 and held in place by the complementary ridge element 67 on the outer clamping arm 32. A depressible snap-in locking tab 70 or other suitable reversible latching mechanism may be used to hold the clamping arms in place during use until a new bag is required.

Figure 7:
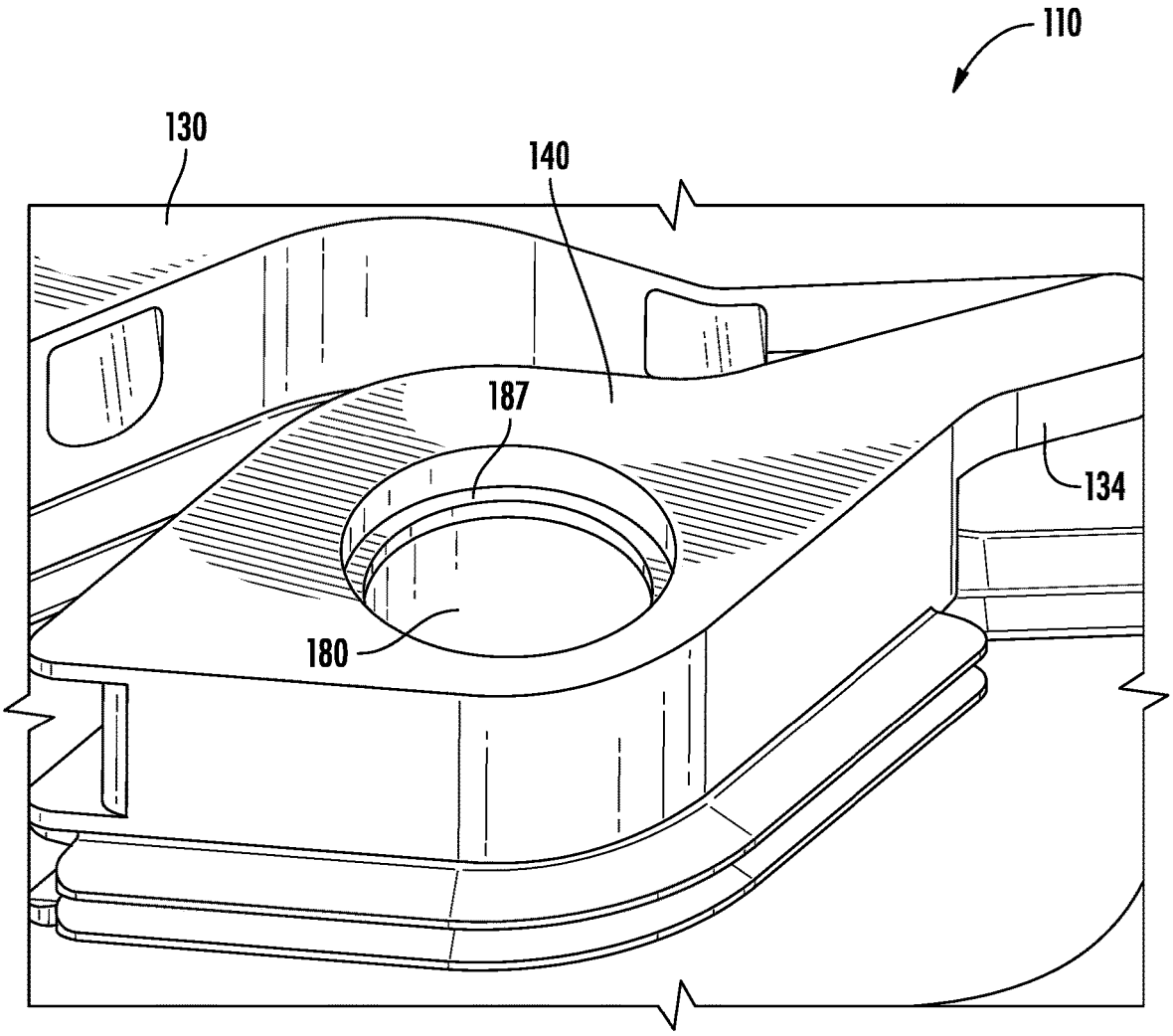
FIG. 7 is a schematic view illustrating an alternative embodiment of a wall-mountable dispenser consistent with the present disclosure adapted for acceptance of interchangeable grommets (not shown) defining pass-through surface openings to allow for different fabrics and/or tear strengths.
Figure 8:
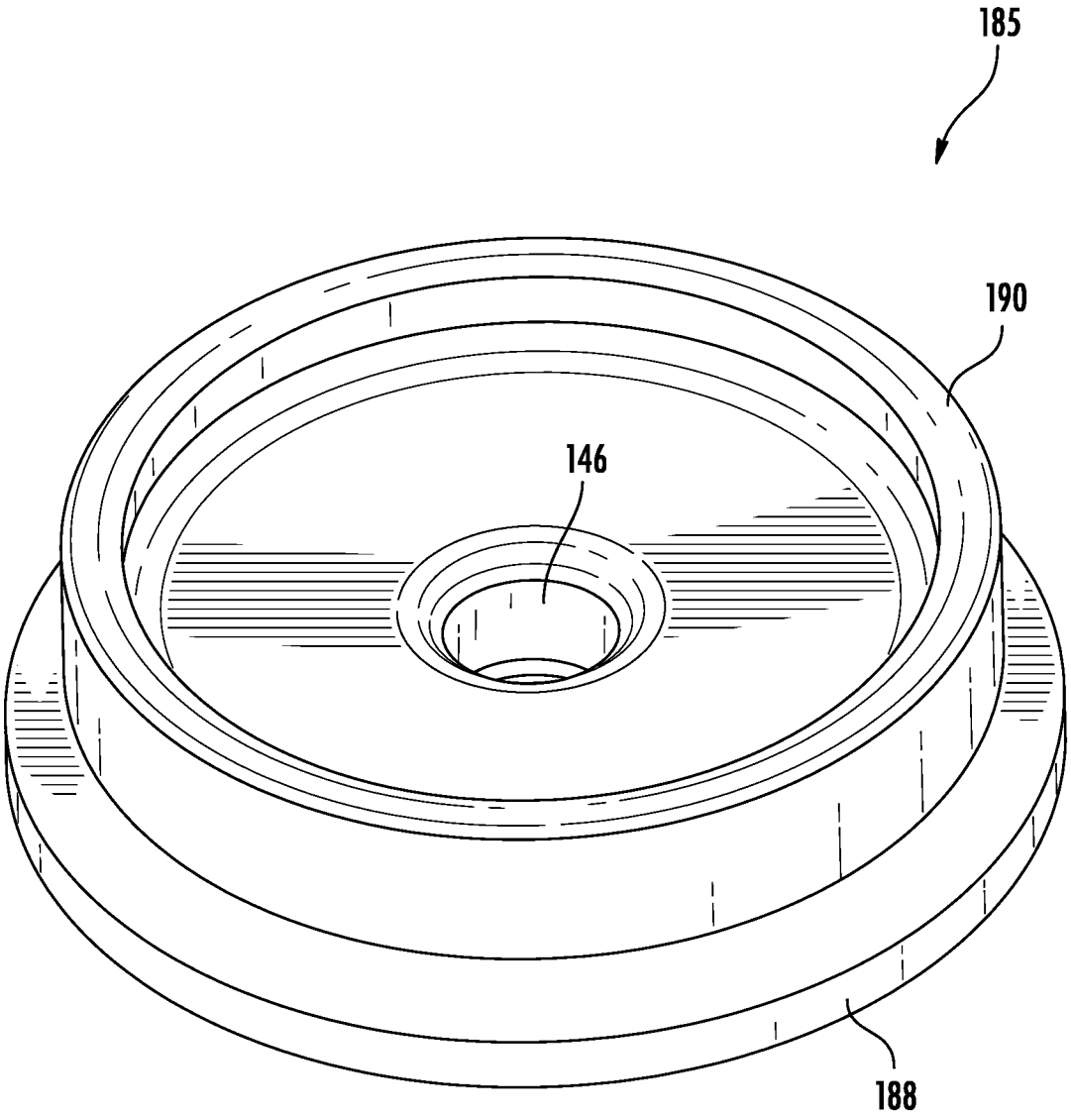
FIG. 8 illustrates an exemplary interchangeable grommet for use in the embodiment shown in FIG. 7.
Figure 9:
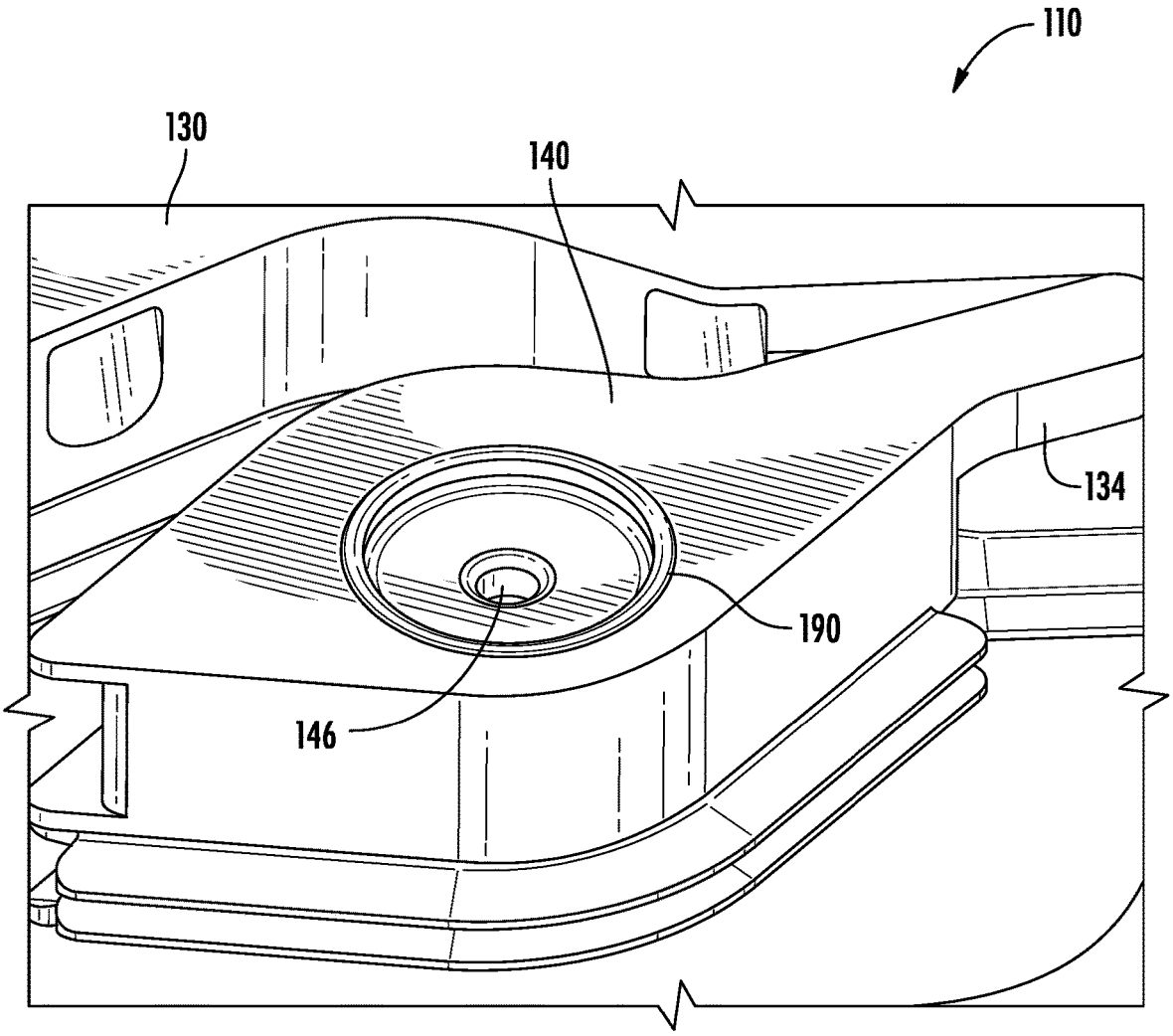
FIG. 9 is a view similar to FIG. 7 with the interchangeable grommet in place to define a pass-through surface opening.

FIGS. 7-9 illustrate an alternative and potentially preferred embodiment in accordance with the present disclosure wherein like elements to those previously described are designated by like reference numerals increased by 100. As illustrated, in the alternative embodiment of FIGS. 7-9, the floating island 140 may include a hollow well 180 in place of the star opening or other integral pass-through surface opening. The hollow well 180 may be adapted to receive a replaceable grommet 185 (FIG. 8) including a pass-through surface opening 146 for withdrawal of the wipes during use. In this regard, the grommet 185 is preferably formed from relatively low-durometer rubber or other pliable material to facilitate deformation when pressed into the hollow well 180.

As best seen in FIG. 7, hollow well 180 preferably includes a circumferential shelf 187 at an intermediate elevation within its interior. Grommet 185 likewise may include a complimentary shoulder 188 disposed around a lower perimeter of an annular wall 190. During assembly, the pliable grommet 185 may be pressed into hollow well 180 causing the annular shoulder 188 to be captured below the circumferential shelf 187. In this condition, the circumferential shelf 187 also presses against annular wall 190 to establish a substantially fluid tight compression fit. In this condition, individual wipes may thus be withdrawn through the pass-through surface opening 146.

As will be appreciated, the embodiment of FIGS. 7-9 facilitates adjustment to accommodate wipe materials of different constructions and/or tear strengths by changing the grommet being used. By way of example only, a grommet with a smaller pass-through surface opening 146 may be used for thinner wipe materials while a grommet with a larger pass-through surface opening 146 may be used for thicker materials. Since the grommets may be easily changed, an array of different wipe materials may thus be accommodated. If desired, a covering shroud (not shown) such as a half-cylinder with an access door or other design as may be desired may be used in any of the described embodiments to cover the bag during use. However, such a shroud is not essential and will not alter the operation of the dispenser.

Of course, it is to be understood that variations and modifications of the foregoing are within the scope of the present disclosure. Thus, it is to be understood that the disclosure disclosed and defined herein extends to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments and equivalents to the extent permitted by the prior art.

The use of the terms "a" and "an" and "the" and similar referents in the context of describing the disclosure are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

What is claimed is:

1. A wipe dispensing system adapted to be mounted to a substantially flat vertical support surface, the dispensing system comprising: a dispenser and a pliable bag containing wipes and optionally a saturating solution, the bag being disposed in clamped, hanging relation to the dispenser;

the dispenser comprising a mountable base adapted to be secured to the support surface, the dispenser further comprising a cover disposed in overlying relation to the base;

wherein the cover of the dispenser comprises an outer shroud portion disposed over an interior flooring surface, and a selectively openable door defining an opening in the outer shroud;

wherein the base of the dispenser comprises a mounting arm adapted to be operatively attached to the support surface and to the cover, the base further comprising an outer clamping arm and an interior clamping arm, the interior clamping arm comprising a proximal arm segment extending away from a hinging axis to a floating island comprising a pass through opening adapted to receive a wipe from the pliable bag, wherein the outer clamping arm and the interior clamping arm are each disposed in independent hinging relation to the mounting arm and the interior clamping arm is positioned between the outer clamping arm and the mounting arm such that upon rotation of the outer clamping arm towards the mounting arm, the floating island is clamped between the outer clamping arm and the mounting arm with and a first portion of the bag clamped between the floating island and the outer clamping arm and a second portion of the bag clamped between the floating island and the mounting arm.

2. The wipe dispensing system as recited in claim 1, wherein the outer shroud porting is of a split dome configuration with a substantially flat rear surface and a convex curved outer face.

3. The wipe dispensing system as recited in claim 1, wherein the interior flooring surface is integral with the outer shroud portion.

4. The wipe dispensing system as recited in claim 1, wherein the cover further comprises an internal access compartment including raised walls extending upwardly away from the flooring surface.

5. The wipe dispensing system as recited in claim 4, wherein the door is openable to the internal access compartment.

6. The wipe dispensing system as recited in claim 1, wherein the door is normally biased to a closed position by a spring hinge.

7. The wipe dispensing system as recited in claim 1, wherein the mounting arm comprises a substantially flat rear arm surface and one or more mounting tabs extending above the rear arm surface, the mounting tabs including openings adapted to engage attachment elements to operatively secure the base in opposing relating to the support surface.

8. The wipe dispensing system as recited in claim 1, wherein the mounting arm further includes a plurality of platform posts having portions extending over the interior flooring surface of the cover.

9. The wipe dispensing system as recited in claim 1, wherein the floating island has an effective diameter greater than the proximal arm segment.

10. The wipe dispensing system as recited in claim 1, wherein said pass through opening comprises an integral opening within the floating island.

11. The wipe dispensing system as recited in claim 1, wherein said pass through opening comprises an opening in a pliable grommet held within the floating island.

12. The wipe dispensing system as recited in claim 1, wherein the floating island is clamped between complementary indents in the outer clamping arm and the mounting arm.

13. The wipe dispensing system as recited in claim 1, wherein said pass through opening comprises an integral opening within the floating island.

14. The wipe dispensing system as recited in claim 1, wherein said pass through opening comprises an opening in a pliable grommet held within the floating island.

15. A wipe dispensing system adapted to be mounted to a substantially flat vertical support surface, the dispensing system comprising: a dispenser and a pliable bag containing wipes in clamped, hanging relation to the dispenser;

The dispenser comprising a mountable base adapted to be secured to the support surface, the dispenser further comprising a cover disposed in overlying relation to the base;

wherein the cover of the dispenser comprises an outer shroud portion having have a split dome configuration with a substantially flat rear surface and a convex curved outer face disposed over an interior flooring surface integral with the outer shroud portion, the cover further comprising an internal access compartment including raised walls extending upwardly away from the flooring surface and a selectively openable door defining an opening to the internal access compartment, the door being normally biased to a closed position by a spring hinge;

wherein the base of the dispenser comprises a mounting arm adapted to be attached to the support surface, the mounting arm comprising a substantially flat rear arm surface and one or more mounting tabs extending above the rear arm surface, the mounting tabs including openings adapted to engage attachment elements to operatively secure the base in opposing relating to the support surface, the mounting arm further including a plurality of platform posts having portions extending over the flooring surface of the cover, the base further comprising an outer clamping arm and an interior clamping arm, the interior clamping arm comprising a proximal arm segment extending away from a hinging axis to a floating island, the floating island having an effective diameter greater than the proximal arm segment and comprising a pass through opening adapted to receive a wipe from the pliable bag, wherein the outer clamping arm and the interior clamping arm are each disposed in independent hinging relation to the mounting arm and the interior clamping arm is positioned between the outer clamping arm and the mounting arm such that upon rotation of the outer clamping arm towards the mounting arm, the floating island is clamped between complementary indents in the outer clamping arm and the mounting arm with and a first portion of the bag clamped between the floating island and the outer clamping arm and a second portion of the bag clamped between the floating island and the mounting arm.

* * * * *